US012644252B2

(12) United States Patent
Wahlgren et al.

(10) Patent No.: US 12,644,252 B2
(45) Date of Patent: Jun. 2, 2026

(54) DREDGE SYSTEM

(71) Applicant: Eddy Pump Corporation, El Cajon, CA (US)

(72) Inventors: Daniel Wahlgren, Escondido, CA (US); Roberto Gonzalez, Chula Vista, CA (US)

(73) Assignee: Eddy Pump Corporation, El Cajon, CA (US)

( * ) Notice: Subject to any disclaimer, the term of this patent is extended or adjusted under 35 U.S.C. 154(b) by 426 days.

(21) Appl. No.: 18/196,201

(22) Filed: May 11, 2023

(65) Prior Publication Data

US 2023/0374751 A1 Nov. 23, 2023

Related U.S. Application Data

(60) Provisional application No. 63/343,678, filed on May 19, 2022.

(51) Int. Cl.

| | |
|---|---|
| ***E02F 3/90*** | (2006.01) |
| ***E02F 3/14*** | (2006.01) |
| ***E02F 3/88*** | (2006.01) |

(52) U.S. Cl.

CPC ..... *E02F 3/90* (2013.01); *E02F 3/141* (2013.01); *E02F 3/8825* (2013.01)

(58) Field of Classification Search

CPC ..... E02F 3/8825; E02F 3/8841; E02F 3/9256; E02F 3/9268; E02F 3/9281; E02F 3/9293

See application file for complete search history.

(56) References Cited

U.S. PATENT DOCUMENTS

| | | | | |
|---|---|---|---|---|
| 2,205,490 | A | 6/1940 | Peterson | |
| 5,209,099 | A | 5/1993 | Saunders | |
| 5,528,844 | A * | 6/1996 | Ellis | B01D 29/05 37/444 |
| 6,033,154 | A * | 3/2000 | Curtis | E02F 3/8808 405/269 |
| 7,552,551 | B2 | 6/2009 | Kohutko | |
| 2022/0356671 | A1 | 11/2022 | Wahlgren et al. | |

FOREIGN PATENT DOCUMENTS

| | | | |
|---|---|---|---|
| CN | 206736991 | U | 12/2017 |
| CN | 109577399 | A | 4/2019 |
| CN | 210369112 | U | 4/2020 |
| CN | 210712998 | U | 6/2020 |

(Continued)

OTHER PUBLICATIONS

Office Action received for Canadian Patent Application No. 3,199,832, mailed on Nov. 5, 2024, 6 pages.

(Continued)

*Primary Examiner* — Matthew Troutman
(74) *Attorney, Agent, or Firm* — Spencer Fane, LLP

(57) ABSTRACT

A dredge system includes a dredger, a conduit and a self-priming pump. The dredger has an internal area and an outlet, and is configured to feed material into the internal area of the dredger. The conduit is coupled to the dredger adjacent the outlet and configured to transport the material from the internal area of the dredger to a receptacle. The self-priming pump is coupled to the conduit and is configured to pump the material from the outlet to the receptacle.

20 Claims, 15 Drawing Sheets

(56) References Cited

FOREIGN PATENT DOCUMENTS

| | | | | | |
|---|---|---|---|---|---|
| CN | 213741290 | U | | 7/2021 | |
| CN | 215759269 | U | | 2/2022 | |
| CN | 114775718 | B | * | 2/2023 | ..... E02F 5/28 |
| CN | 114508145 | B | * | 7/2025 | ..... E02F 3/9256 |
| EP | 0259472 | B1 | | 9/1991 | |
| JP | H01203526 | A | | 8/1989 | |
| JP | 2006097343 | A | | 4/2006 | |
| KR | 10-1208991 | B1 | | 12/2012 | |
| WO | WO-8705649 | A1 | * | 9/1987 | ..... E02F 3/8841 |
| WO | WO-2004089557 | A1 | * | 10/2004 | ..... E02F 3/9281 |

OTHER PUBLICATIONS

Chilean Office Action issued May 22, 2024 in corresponding Chilean Application No. 202301443 (Google machine transation).
Non-Final Rejection received in United Arab Emirates Application No. P6002215/2023, mailed on Dec. 16, 2024 3 pages.
Office Action received for Canadian Patent Application No. 3,199,832, mailed on Nov. 6, 2025, 5 pages.

* cited by examiner

DREDGE SYSTEM

CROSS-REFERENCE TO RELATED APPLICATIONS

This application claims priority to U.S. Provisional Application No. 63/343,678, filed May 19, 2022, the contents of which are hereby incorporated by reference.

BACKGROUND

Field of the Invention

The present disclosure relates to a dredge system. In particular the present disclosure relates to a dredge system that includes a dredging device that is connectable to a pump system.

Background of the Invention

Conventional dredging generally requires four separate steps. For example, conventional dredging usually requires loosening material, extracting the material, transportation and disposal. One conventional dredging system is a trailing suction hopper dredger (TSHD) that trails a suction pipe when working. The pipe, which is fitted with a dredge drag head, loads the dredge spoil into one or more hoppers in the vessel. When the hoppers are full, the TSHD moves to a disposal area and either dumps the material through doors in the hull or pumps the material out of the hoppers.

SUMMARY

It has been determined that an improved dredge system is desired. In view of the state of the known technology, a first aspect of the present disclosure is to provide a dredge system that includes a dredger, a conduit and a self-priming pump. The dredger has an internal area and an outlet, and is configured to feed material into the internal area of the dredger. The conduit is coupled to the dredger adjacent the outlet and is configured to transport the material from the internal area of the dredger to a receptacle. The self-priming pump is coupled to the conduit and is configured to pump the material from the outlet to the receptacle.

A second aspect of the present disclosure according to the first aspect is to provide a dredge system, wherein the dredger is a bucket of an excavator.

A third aspect of the present disclosure according to the first or second aspect is to provide a dredge system, wherein the outlet is disposed in a rear side of the bucket.

A fourth aspect of the present disclosure according to any one of the preceding aspects to provide a dredge system, wherein the self-priming pump is disposed remotely from the dredger.

A fifth aspect of the present disclosure according to any one of the preceding aspects to provide a dredge system, wherein the dredger includes a grate disposed over an opening thereof.

A sixth aspect of the present disclosure according to any one of the preceding aspects to provide a dredge system, wherein the grate is moveably disposed over the opening.

A seventh aspect of the present disclosure according to any one of the preceding aspects to provide a dredge system, the dredger includes an agitator disposed at an opening thereof.

An eighth aspect of the present disclosure according to any one of the preceding aspects to provide a dredge system, wherein the agitator is coupled to a moveable grate.

A ninth aspect of the present disclosure according to the first aspect is to provide a dredge system, further comprising a power unit configured to operate the agitator.

A tenth aspect of the present disclosure is to provide a method of dredging, the method comprising operating a dredger having an internal area and an outlet, to feed material into the internal area of the dredger; and operating a self-priming pump to pump the material from the outlet to a receptacle via a conduit, the conduit coupled to the dredger adjacent the outlet at a first end and the self-priming pump at a second end.

An eleventh aspect of the present disclosure according to any one of the preceding aspects to provide a dredge system, wherein the dredger is a bucket of an excavator.

A twelfth aspect of the present disclosure according to any one of the preceding aspects to provide a dredge system, wherein the outlet is disposed in a rear side of the bucket.

A thirteenth aspect of the present disclosure according to any one of the preceding aspects is to provide a dredge system, wherein the self-priming pump is disposed remotely from the dredger.

A fourteenth aspect of the present disclosure according to any one of the preceding aspects to provide a dredge system, further comprising shearing the material with a grate disposed over an opening of the dredger.

A fifteenth aspect of the present disclosure according to any one of the preceding aspects to provide a dredge system, wherein the grate is moveably disposed over the opening.

A sixteenth aspect of the present disclosure according to any one of the preceding aspects to provide a dredge system, comprising shearing with an agitator disposed at an opening of the dredger.

A seventeenth aspect of the present disclosure accord according to any one of the preceding aspects to provide a dredge system, wherein the agitator is coupled to a moveable grate.

An eighteenth aspect of the present disclosure according to any one of the preceding aspects to provide a dredge system, further comprising operating the agitator with a power.

Embodiments of the present invention improve the dredging process by providing a movable vehicle that loosens material, extracts material and transports the material to be disposed in one process. Thus, the present invention can decrease the time and expense in dredging.

Moreover, Embodiments of the present invention are able to remove or dredge dry material using a self-priming pump that is disposed away from the dredger.

BRIEF DESCRIPTION OF THE DRAWINGS

The invention will be explained in more detail hereinafter with reference to the drawings.

DETAILED DESCRIPTION OF THE EMBODIMENTS

Figure 1:
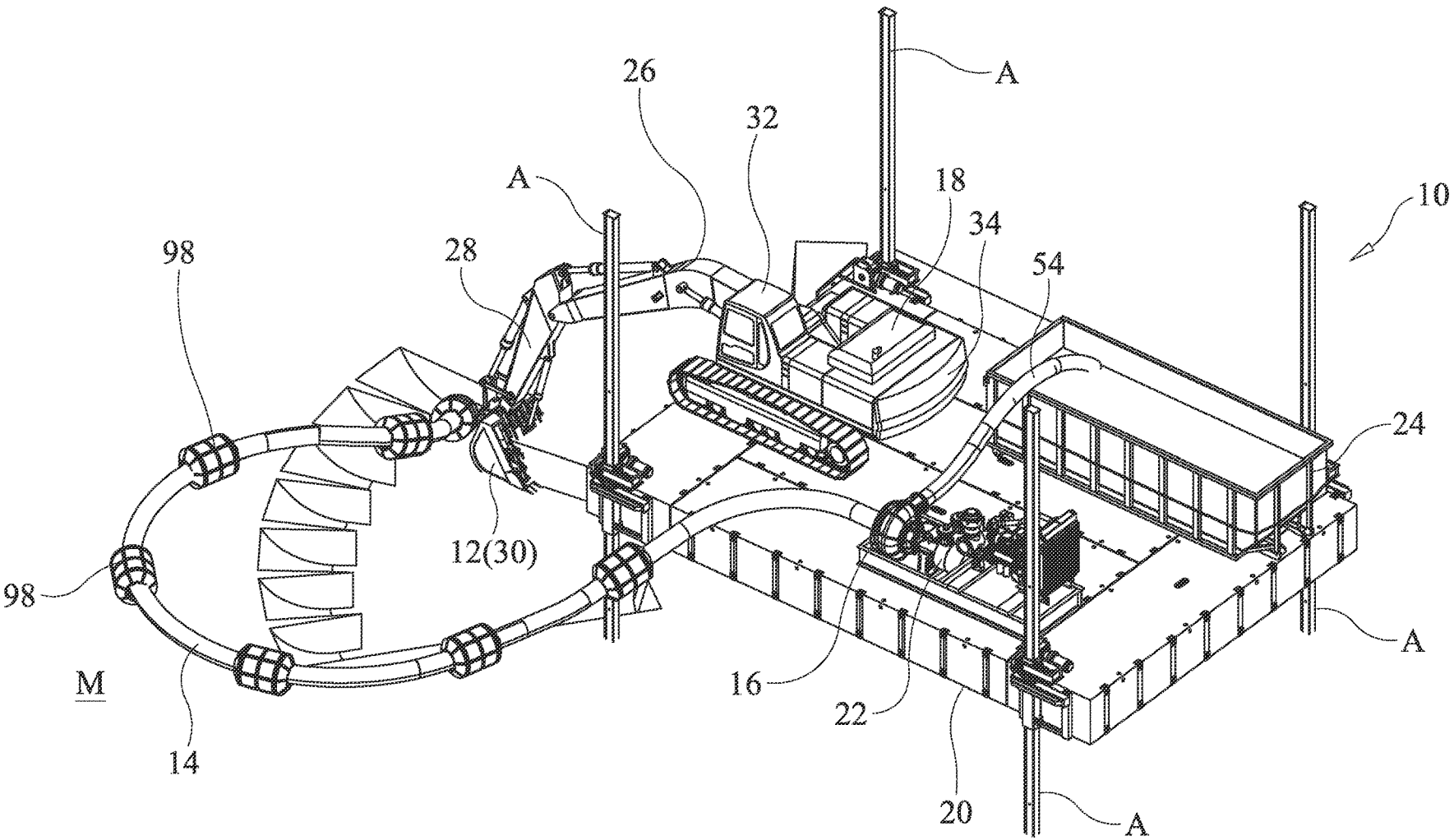
FIG. 1 is a top perspective view of a dredge system according to an embodiment of the present invention disposed on the front of a vehicle.

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Referring initially to the Figures, a dredge system 10 includes a dredger 12, a conduit 14 coupled and a self-priming pump 16. As shown in the Figures, the dredger 12 can be a bucket 30 of a construction vehicle 18 disposed on a barge 20. The self-priming pump 16 can be an element of a pumping system 22 that is capable of pumping material M from the dredger 12 through the conduit 14 to a receptacle 24.

The constructions vehicle can be positioned on a barge 20 or other structure that enables the construction vehicle 18 to move over liquid or slurry so that the solid or semi-solid material M can be excavated. In the illustrated embodiment the barge 20 is configured to be sufficiently buoyant to support the construction vehicle 18, the pumping system 22 and a reservoir. The barge 20 can have vertical anchoring devices that enable the barge 20 to be anchored in a static position on the liquid, but easily moved to excavate other areas. However, is noted that the construction vehicle 18 can be positioned on dry land or any other suitable environment for excavating or moving any desired material M.

In one embodiment, the construction vehicle 18 is an excavator. As can be understood, an excavator (i.e., the construction vehicle 18) can include a boom 26, dipper 28 (or stick), bucket 30 and cab 32 on a rotating platform 34 known as the house. The house 34 sits atop an undercarriage 36 with tracks or wheels 38. The excavator 18 can have hydraulics 40 or any other suitable devices to move the dipper 28, boom 26, bucket 30 and cab 32, as is known in the art. However, the construction vehicle 18 can be any suitable construction vehicle 18 or other vehicle type that would enable a bucket 30, blade, hopper, plow or any other excavating device or dredger to be attached thereto. For example, the construction vehicle 18 can be a backhoe, a bulldozer, a tractor, front loader or any other vehicle or truck suitable to excavate the desired material M.

Figure 14:
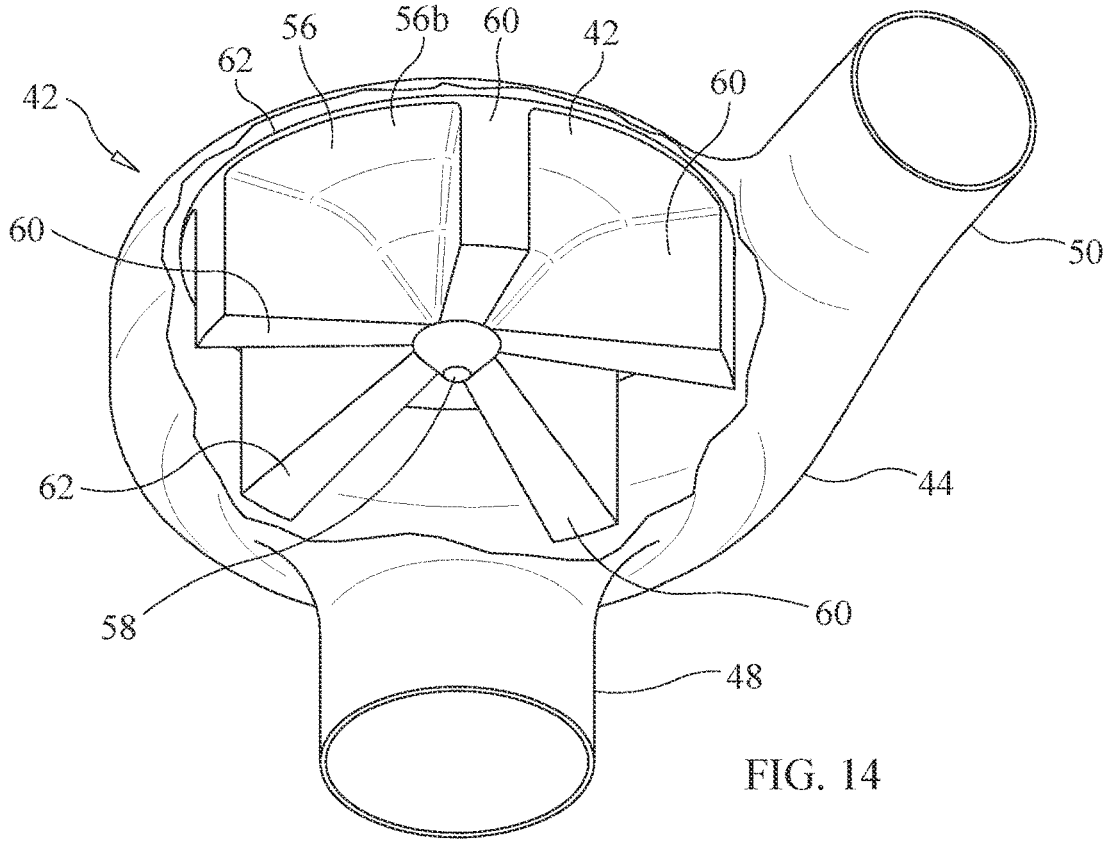
FIG. 14 is bottom perspective view in section illustrating one embodiment of an eddy pump used in the pump of FIG. 12.
Figure 15:
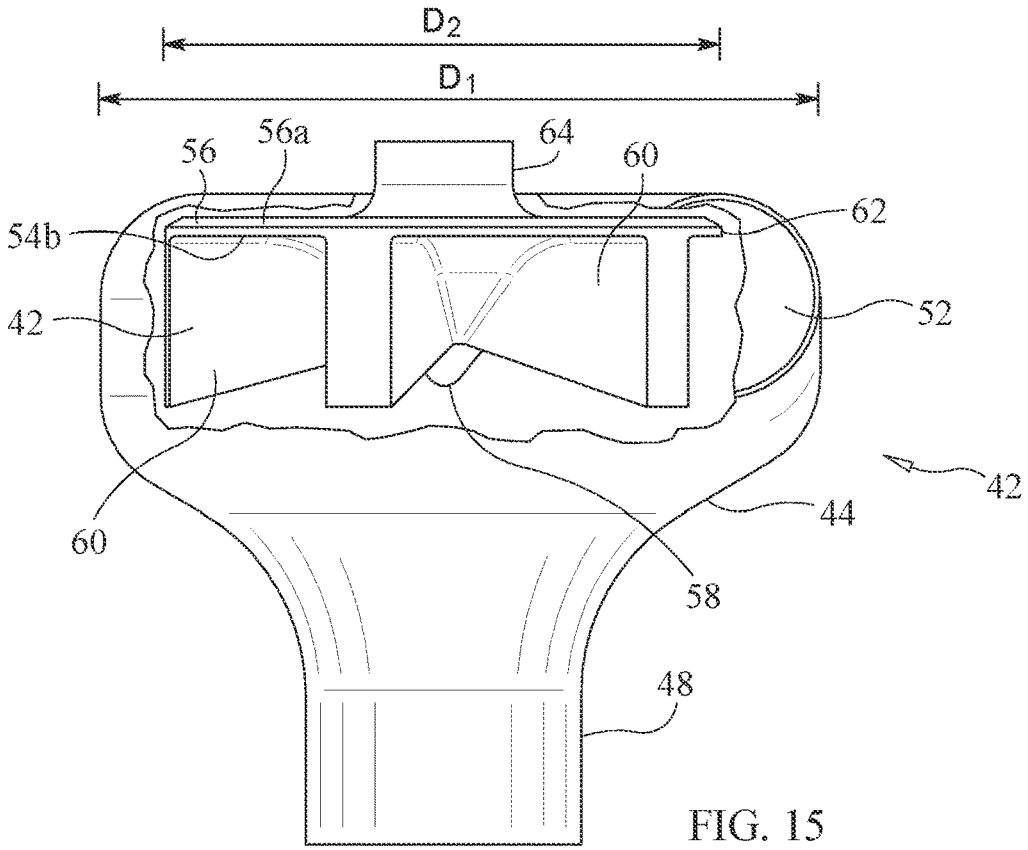
FIG. 15 is a side view in section illustrating the embodiment of an eddy pump of FIG. 12.
Figure 16:
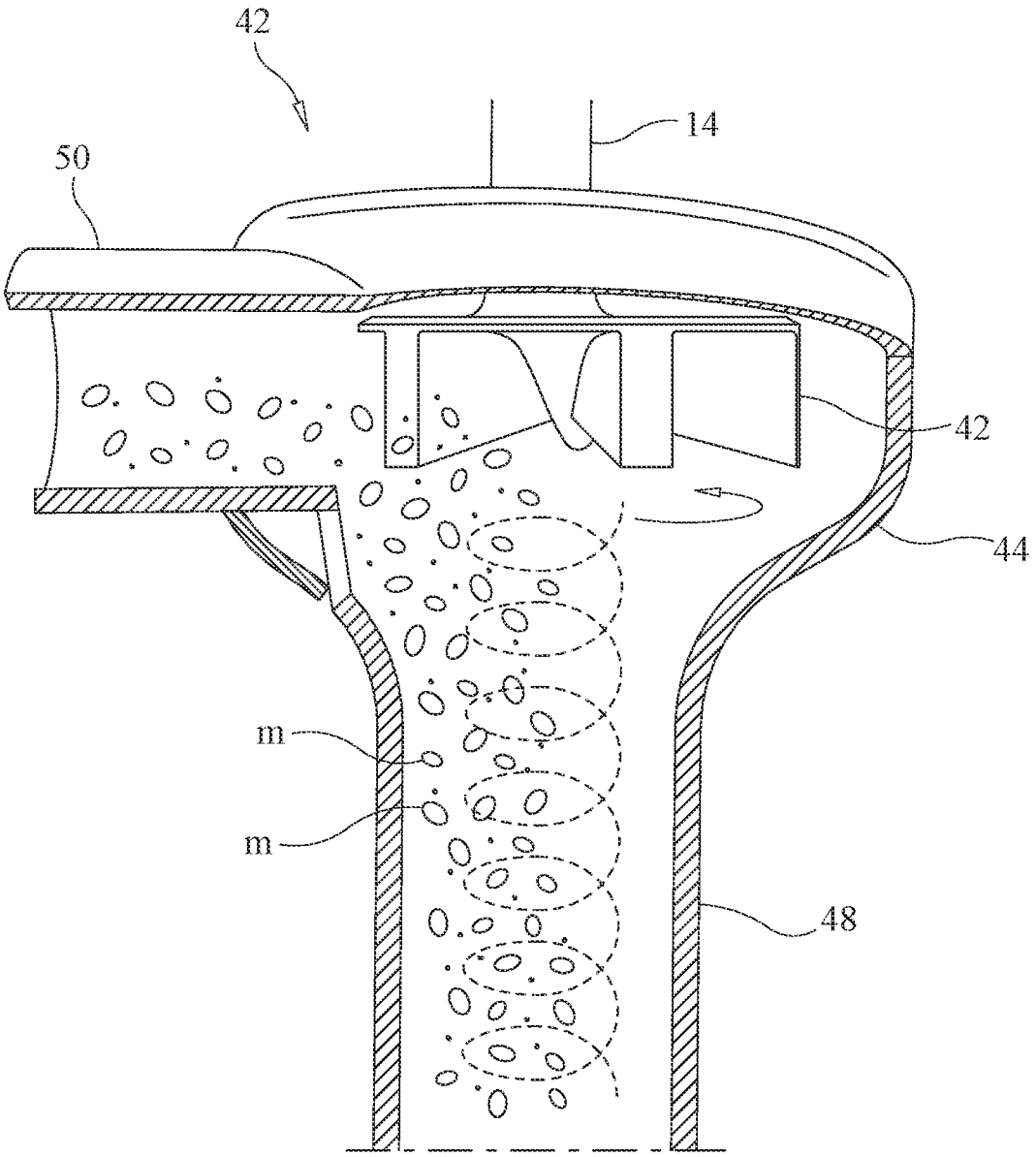
FIG. 16 is another side view in section illustrating the embodiment of an eddy pump of FIG. 12 in operation.

As shown in FIGS. 14-16, the self-priming pump 16 includes an impeller 42 and a volute casing 44. The impeller 42 and volute casing 44 can be surrounded by a tank so that it will always be immersed in a liquid sufficient to start the pump 16 and provide the pump 16 with lubrication and cooling. As can be understood, self-priming in this application means that the pump 16 has the ability to use liquid stored in its housing to generate a vacuum on the suction line.

That is, the pump can be an eddy pump, for example, as described in U.S. patent application Ser. No. 16/176,495, filed Oct. 31, 2018 and entitled Eddy Pump, the entire contents of which are herein incorporated by reference.

As discussed, the pump can be disposed on the barge 20 and is in communication with the conduit 14. As shown in FIGS. 11-15, the pump 16 includes a drive motor 46, a volute or housing 44 and a rotor 42. The rotor 42 is disposed within the housing 44 such that fluid, liquids, materials, and slurries can enter the housing 44 and be pumped by the rotor 42. The rotor 42 is connected to the drive motor 46 that is configured to drive or rotate the rotor 42 to pump fluid, liquids, material, and slurries from the inlet 48 to the discharge outlet 50. The motor 46 can be any suitable motor know in the art that would be capable of driving the rotor 42 at suitable rotational velocities.

As shown in FIGS. 14-16, the housing 44 is curved and includes inlet 48 and discharge outlet 50. The inner surface 52 of the housing 44 is generally cylindrical and has a diameter D1 that is larger than the diameter D2 of the rotor 42. The inlet 48 is disposed along a radial axis of the rotor 42 on the bottom of the housing 44, which enables the fluid or material M to be sucked or drawn into the housing 44 based on the rotation of the rotor 42. The outlet 50 is disposed 90 degrees offset from the inlet 48 (i.e., in a direction tangential to the rotor), which enables the fluid or material M to be pumped out of the housing 44 and is connected to the conduit 54.

The rotor 42 includes a back plate 56, a conical center portion (hub) 58 and a plurality of blades 60. The rotor 42 can be cast, molded, forged, machined, or formed in any suitable manner. Thus, the back plate 56, the conical center portion 58 and the plurality of blades 60 can be formed as a unitary one-piece member. The rotor 42 can be an alloy, steel, stainless steel, aluminum, zinc, bronze, rubber, plastic or any other suitable material or combination of materials. Moreover, it is noted that the rotor 42 can be any suitable mater or design. Thus, while the rotor 42 is preferable a unitary one-piece member, the rotor can be formed from in multiple steps or by multiple pieces that are assembled in any suitable manner.

In one embodiment, the back plate 56 is a generally circular plate having a first side (defining a first planar surface) 56*a*, a second side (defining a second planar surface) 56*b* and an outer circumferential edge 62. The first or upper side 56*a* faces the interior of the housing 44 and has a protrusion or shaft 64 extending therefrom. The protrusion 64 is connected to or connectable to a drive shaft from the drive motor. The second side 56*b* has the plurality of blades 60 disposed thereon. As shown in the FIGS. 13 and 14, the back plate 56 extends form the center of the rotor 42 about the same length as the rotor blades 60, and thus covers the entire rotor blade length. In other words, the plurality of blades 60 defines a radial diameter, and the back plate 56 has a diameter that is the same as or about the same as the radial diameter of the plurality of blades 60. However, it is noted that the radial diameter of the back plate 56 can be between 0.3 and 1.0 the radial diameter defined by the plurality of blades 60, depending on the particle size, or any other parameter. This configuration (i.e., a "full size" back plate) prevents fluid from escaping the rotor 42 and facilitates pushing the fluid circumferentially towards the outlet 50 of the rotor 42 and discharge. Moreover, the back plate 56 helps reduce recirculation by maintaining fluid distribution inside the volume of the rotor 42, and prevents leakage and energy losses between the rotor 42 and upper side of the housing 44. The back plate 56 also helps reduce static pressure loss, which contributes to higher pressure differential and head developed by the rotor 42.

As shown in FIGS. 14 and 15, the conical center portion 58 is a cone disposed in the center of the rotor 42 and facilitates fixing the rotor to the motor shaft. The conical center portion 58 is disposed on the second side 56*b* of the back plate 56 and is opposite to the protrusion 64. The conical center portion 58 has a vertex and a base. The base is adjacent the back plate 56 and tapers toward the conical vertex. The base radially extends about 50 percent of the base plate 56. The conical vertex of the hub of the conical center portion 58 forms an angle of about 40 degrees. However, the size of the base of the conical center portion and the angle formed by the conical vertex can be any suitable or desired size or angle.

The conical center portion 58 helps hydraulically by causing suction which enables the fluid to flow inside the housing smoothly from the inlet 48 and facilitates laminar movement towards the outlet 50 or end of the rotor 42 and subsequently to the discharge. This induction of laminar flow aids in reduction of eddy currents and recirculation inside the housing, increasing pump efficiency. The size of the conical center portion 58 (length, diameter, and angle) can depend on the particle size, allowing better clearances of the particles, as long as laminar flow can be maintained towards the discharge. The conical center portion 58 also helps create better eddy current from the suction to the inlet 48 of the rotor 42 while preventing turbulence at higher flow rates than the best efficiency point allowing the pump 16 a flow rate 140% of the design best efficiency point. The size of the cone can be reduced or increased to control power consumption.

As shown in FIGS. 14 and 15, the plurality of blades 60 extends from the conical center portion 58 and is disposed on the second side 56*b* of the back plate 56. In this embodiment, the plurality of blades 60 includes five (5) blades, but the plurality of blades 60 can be any suitable number of blades that form a suitable eddy current. Each of the blades 60 includes a first side, a second side, an end, and a bottom surface. Each of the blades 60 extends radially outwardly from the conical center portion 58 and along a longitudinal direction from the back plate 56. Moreover, since the conical center portion 58 is a cone having a sloping surface, each of the blades 60 follows the sloping contour of the conical center portion 58, see FIGS. 14 and 15 for example.

The first longitudinal side and a second longitudinal side of the blades 60 are opposite each other. The first and second longitudinal sides extend in the longitudinal direction, generally parallel to the longitudinal axis of the rotor 42 and taper away from each other in the radial direction. That is, as shown in FIGS. 14 and 15, the first and second longitudinal sides are disposed about 1.5 inches apart adjacent the conical center portion and 2 inches apart adjacent the circumferential edge of the back plate 56. Accordingly, as can be understood, the first and second longitudinal sides separate about 0.5 inches in the radial direction. It is noted that the first and second longitudinal sides can separate in any manner desired or can be parallel, if desired. Moreover, if the size of the rotor is changed, the change in separation of the first and second longitudinal sides can be changed accordingly. That is, in the embodiment, the change in the separation of the first and second longitudinal sides is about 33 percent. In other words, the separation between the first and second longitudinal sides at the peripheral edge of the back plate 56 is about 33 percent larger than the separation of the first and second longitudinal sides adjacent the conical center portion 58.

In one embodiment, each of the blades 60 tapers upwardly from the peripheral edge 62 of the back plate 56 to the conical center portion 58. The bottom surface of each blade 60 extends from a first end to a second end. The first end is adjacent the conical center portion 58 and the second end is adjacent to the outer surface. The second end preferably is higher than the first end when measured from the second side of the back plate. For example, in one embodiment, the first end is approximately 3.17 inches from the back plate and the second end is 5 inches from the back plate 56. However, it is noted that the first and second ends can be any suitable distance from the back plate 56. Moreover, if the size of the rotor 42 is changed the change in heights of the first and second longitudinal ends can change accordingly. That is, in this embodiment the difference in the heights of the first and second ends is about 58 percent. In other words, the height of the second end is 58 percent higher than the height of the first end.

The outer surface of the blades 60 can be seen in at least FIGS. 14 and 15. The outer surface is preferably a rectangular and is essentially parallel with a rotational axis of the rotor. As shown specifically in FIG. 15, the outer surface forms a right angle (90 degrees) with the back plate 56. Moreover, the outer surface extends generally parallel with the inner surface of the housing 44 and is spaced a prescribed distance therefrom. Such a configuration enables particles to be disposed between the outer surface of the blades 60 and the inner surface of the housing 44.

Additionally, the bottom surface of the blades 60 forms an angle of 75 degrees with the outer surface and an angle of about 15 degrees with a line parallel to the second side 56*b* of the back plate 56. This tapering results in the conical center portion 58 having a height from the second side 56*b* of the back plate 56 that is greater than the height of the first end and less than the height of the second end of the blades 60. Thus, in one embodiment, the conical center portion 58 has a height of 4.27 inches. Thus, as can be understood, the height of the conical center portion 58 is about 83 percent of the height of the second end and about 38 percent greater than the height of the first end. However, the height of the conical center portion 58 can be any suitable height.

Thus, as can be understood, the height of each of the blades 60 increases from the center of the rotor 42 towards the outside diameter or the peripheral edge 62 of the back plate 56, on the suction side of the rotor 42. This structure enhances the eddy currents for improved suction of fluid and creates clearance for larger particle sizes. The rotor blade 60 height at outside diameter is kept close to the height of the discharge or the diameter of the discharge so as to be capable of pushing fluids directly into the discharge outlet 50. This configuration reduces leakage, recirculation, and pressure losses. The tapering blade height also helps reduce the torque, and thus reduce the power consumed versus uniform blade height from center to outer diameter. The outer blade height can also be varied in proportion to the outlet diameter of the housing 44, keeping the dimensions similar if desired.

As shown in FIGS. 14-16, each of the blades 60 is spaced a predetermined distance from the housing. Generally, the clearance between the blades and the housing is kept at an additional 10-15% of the maximum particle size that is estimated to be in the material M. This enables the rotor 42 to pass particles of significant size while reducing the wear of the blades 60 in the rotor 42.

A rotor 42 having five blades is the preferable number of blades to reduce eddy current formation and recirculation between the rotor blades. It has been found that too few blades can cause turbulence and may not enable higher flow rates to create the required pressure differential. Too many blades may reduce clearances prohibiting larger size particles from passing through the pump and may reduce fluid volume allowable for ideal flow rate. However, the rotor 42 can have any suitable number of blades that will enable some flow with a suitable amount and size of particles to pass through the housing.

Embodiments described herein reduce Net Positive Suction Head (NPSH) because the embodiments can handle lower suction pressures and subsequent cavitation significantly better due to smoother streamlines relative the conventional systems. This improves the suction performance of the pump and reduces the chances of cavitation and pump damage.

As can be understood, embodiments of the pump described herein do not rely on the centrifugal principle of conventional pump. Instead of a low tolerance impeller of a conventional pump, the pump described herein use a specific geometric, recessed rotor to create a vortex of fluid or slurry like that of a tornado. That is, the pump 16 (e.g., the Eddy Pump) operates on the tornado principle. The tornado formed by an Eddy Pump and the rotor generates a very strong, synchronized central column of flow from the pump rotor to the pump inlet and creates a low-pressure reverse eddy flow from the pump inlet to the pump discharge. This action also results in an area of negative pressure near the pump seal. The negative pressure allows the pump to achieve zero leakage.

Further open rotor design described herein has high tolerances that enable any substance that enters the intake to be passed through the discharge without issues. This translates to a significant amount of solids and debris that passes through without clogging the pump. In one embodiment, the pump is capable of pumping up to 70% solids by weight and/or slurries with high viscosity and high specific gravity.

The configuration of the rotor 42 so as to be recessed also creates eddy current that keeps abrasive material M away from critical pump components. This structure improves pump life and reduces pump wear.

The tolerance between the rotor 42 and the housing 44 easily allows the passage of a large objects significantly greater than that of a centrifugal pump. For example, in a 2-inch to 10-inch Eddy Pump the tolerance ranges from 1-9 inches. Thus, this type of pump is preferably for pumping the solid materials from the dredging operation.

The embodiments described herein can have additional advantages, such as low maintenance, minimal downtime, low ownership costs and no need for steel high-pressure pipe line.

Since the Eddy Pump is based on the principle of Tornado Motion of liquid as a synchronized swirling column along the center of intake pipe that induces agitated mixing of solid particles with liquid, suction strong enough for solid particles to travel upwards into the housing or volute and generating pressure differential for desired discharge is created. This eddy current is formed by the pressure differential caused by the rotor and strengthened by turbulent flow patterns in the housing or volute and suction tube. Eddy currents are strengthened by the presence of solid particles which increase the inertial forces in the fluid. The formation of the eddy depends on the suspended solid particles that causes suction. Unlike conventional vortex pump, the rotor directly drives the fluid through the pump with no slip. The Eddy Pump uses the movement of particles and the wake induced from these solid particles to generate Eddy Current and induce suction. Hence, efficiency is 7-10% better than conventional vortex pump, with respect to horsepower. The eddy current generated by the Eddy Pump ensures steady movement of the mixture that leads to excellent non-clumping capabilities and the power to pump a very high concentration of solids, up to 70% by weight, and highly viscous fluids.

While the pump 16 is preferably an Eddy Pump as described herein, the pump can be any suitable pump and is not necessarily limited to an Eddy Pump.

As shown in the FIGS. 4-11, the dredger (e.g., bucket 30) is attached to the distal end 28*a* of the dipper 28. The bucket 30 can be moved with hydraulics as can be understood. The bucket 30 is preferably a metal structure having a rectangular opening 66 and curved configuration when viewed from the side. The bucket 30 can be formed from a metal, such as steel or any other suitable material M. Attached at a lower side 68 at the opening of the bucket 30 are a plurality of teeth 70. The teeth 70 facilitate excavation of material M and guiding the material M into the bucket 30. The bucket 30 includes internal area I and the teeth 70 are configured to feed the material M into the internal area I of the bucket 30. The opening 66 enables the material M to access the internal area I, thus the front 72 of the bucket 30 is completely open to the outer perimeter 74 of the bucket 30 and exposes the internal area, so as to enable the material M to be guided into the internal area I as the bucket 30 moves in the forward direction.

Figure 9:
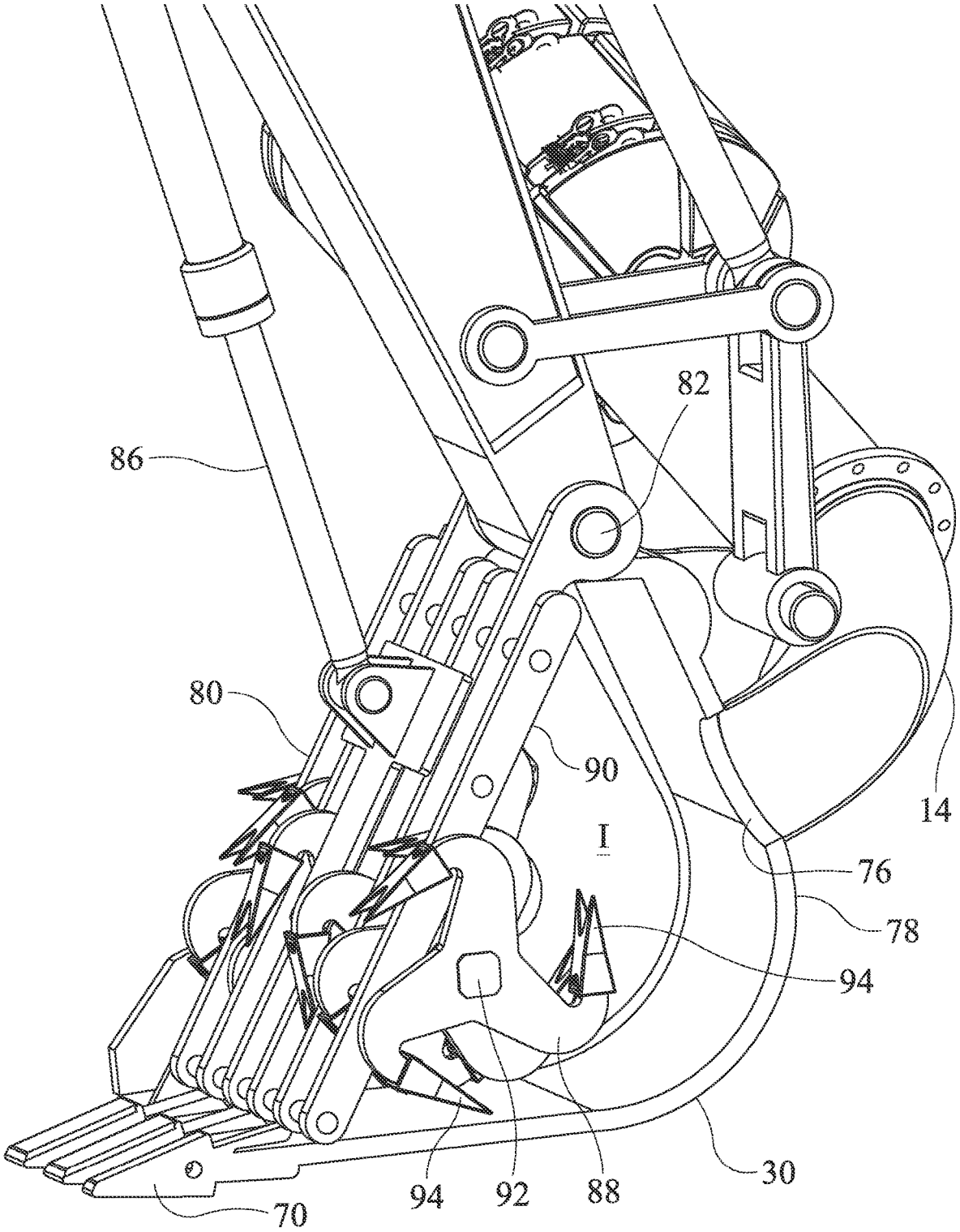
FIG. 9 is a side view in section of the bucket shown in FIG. 5.
Figure 10:
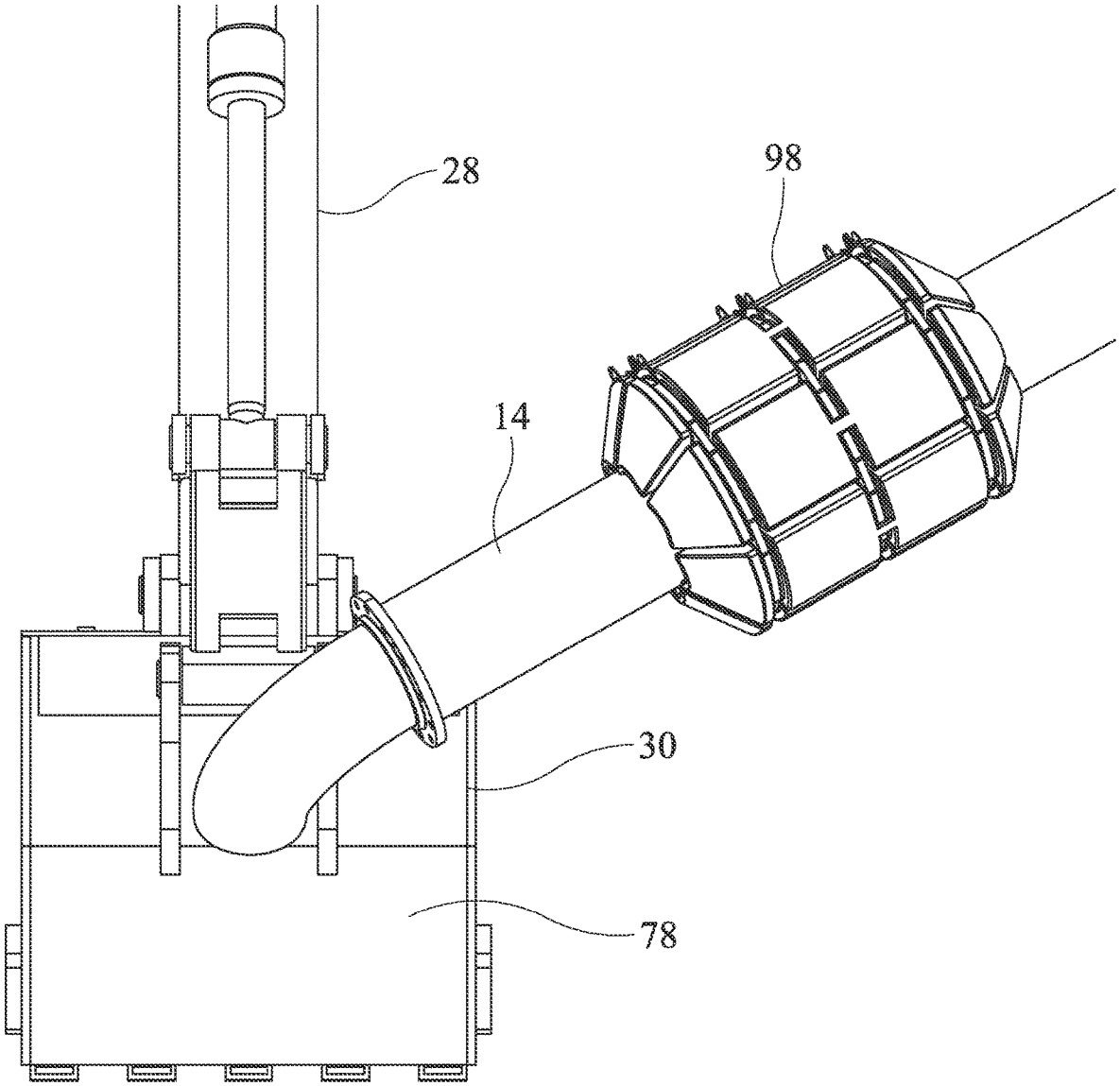
FIG. 10 is a rear view of the bucket shown in FIG. 5.
Figure 11:
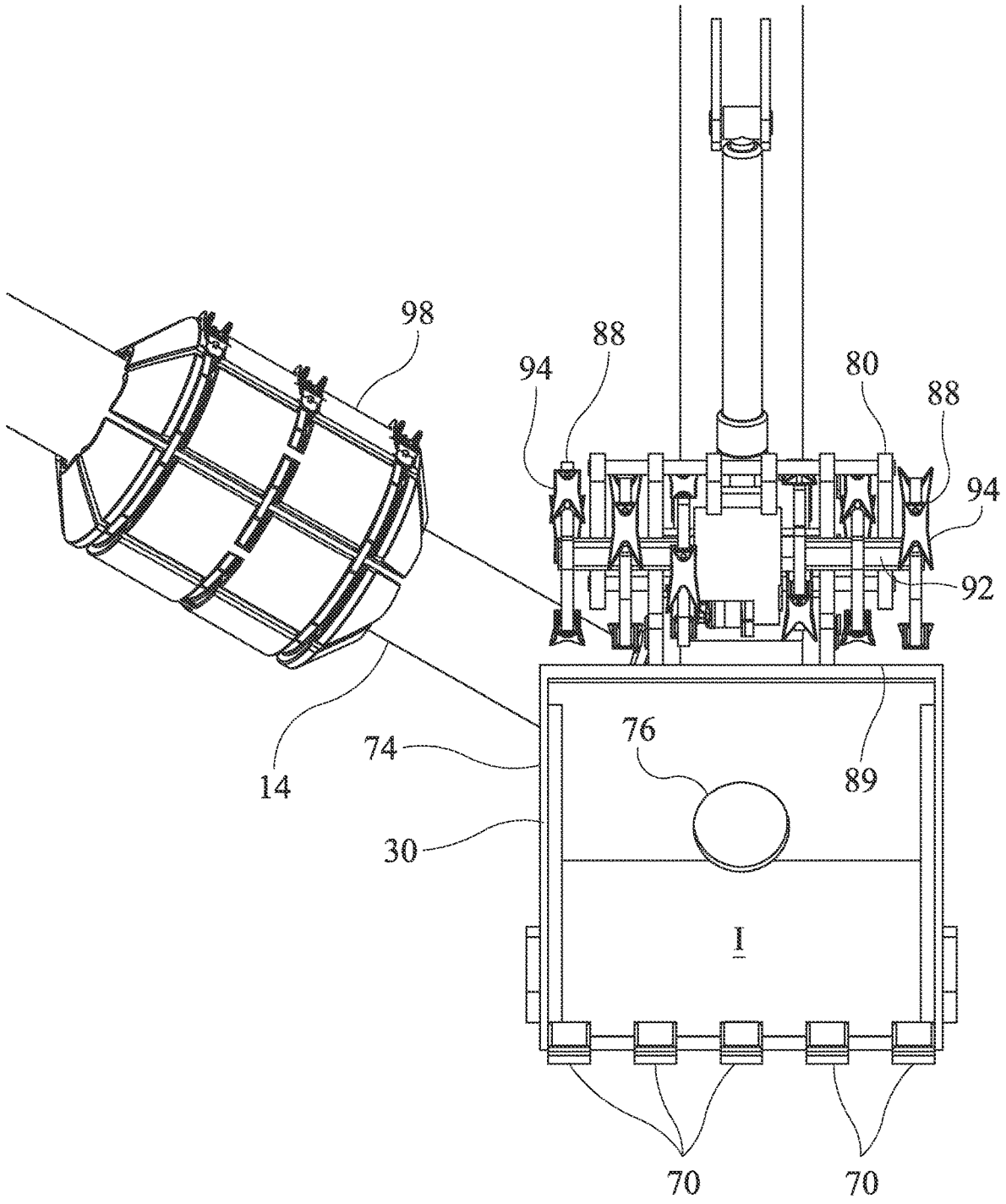
FIG. 11 is front view of the bucket shown in FIG. 5 with the grate in an open position.
Figure 12:
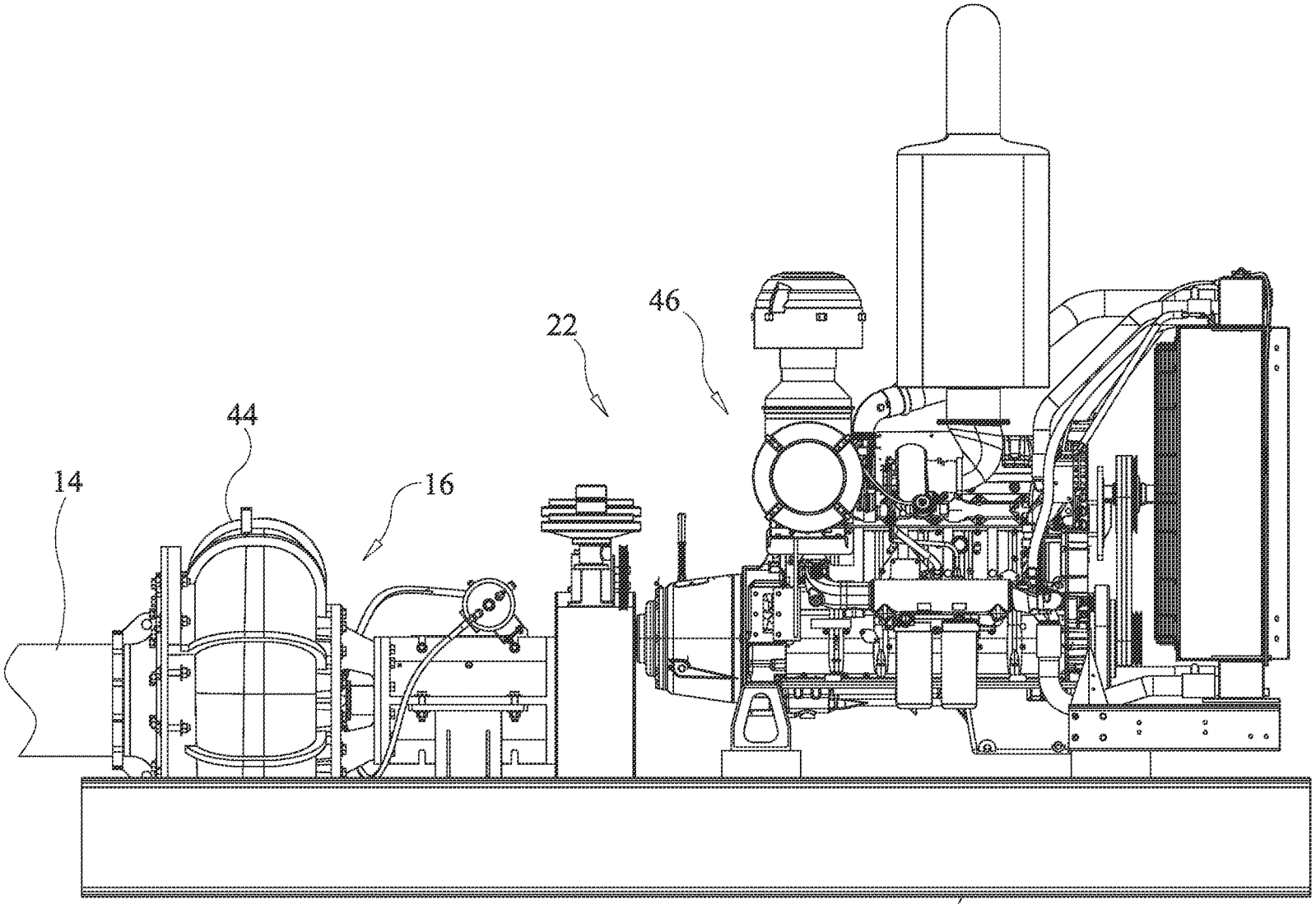
FIG. 12 is a side elevational view of the pump used in the dredge system of FIG. 1.
Figure 13:
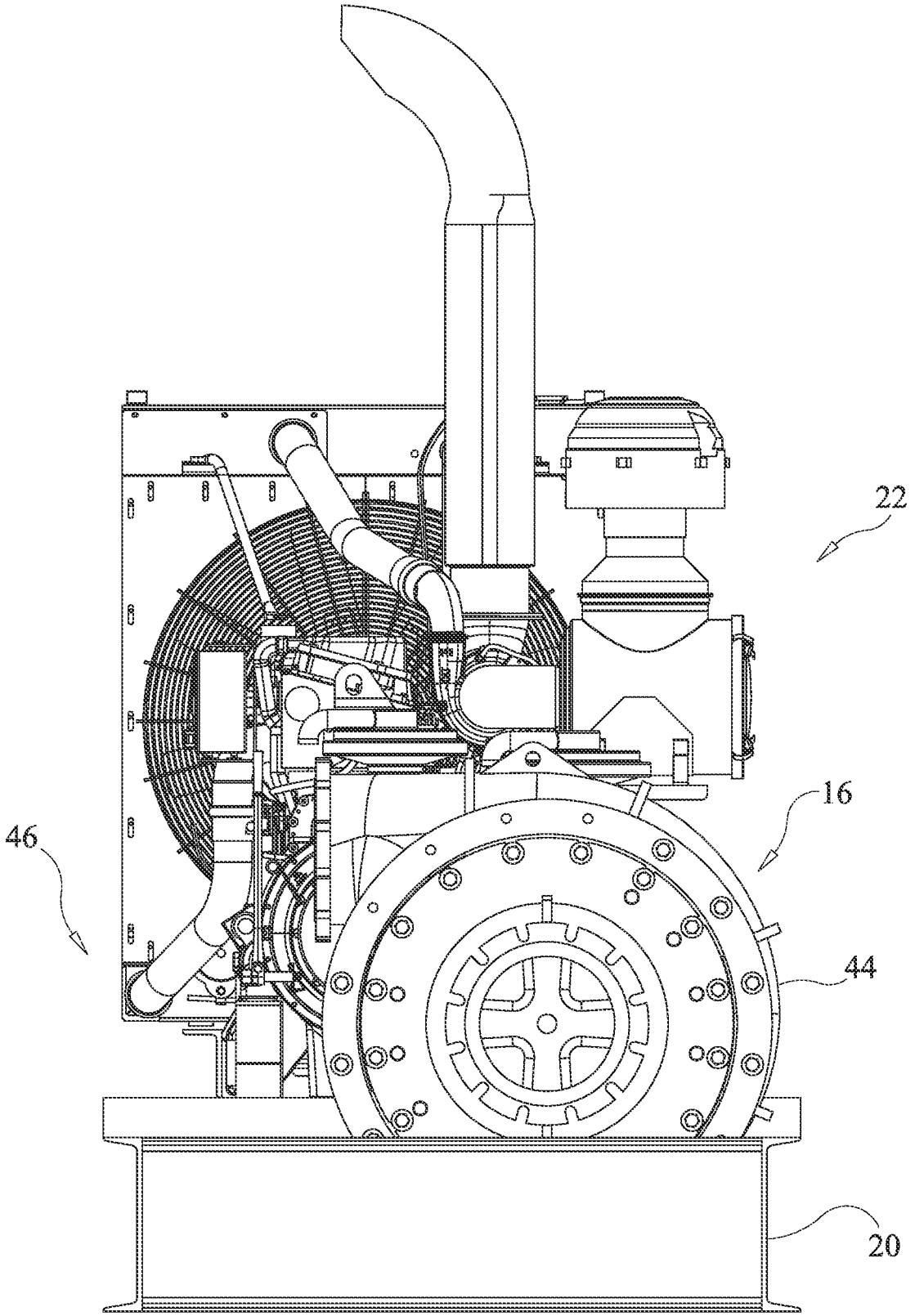
FIG. 13 is an end view of the pump used in the dredge system of FIG. 1.

As shown in FIGS. 9 and 11, an opening 76 is disposed in the rear surface 78 of the bucket 30 that enables the material M to pass out of the bucket 30 and into the conduit 14. As can be understood, the pump 16 will create suction that draws or sucks the material M out of the internal area I of the bucket 30 and into the conduit 14. The opening 76 can be any size and is generally sized and configured to enable slurry material M to pass therethrough.

In one embodiment, as shown in the FIGS. 4-11, the bucket 30 includes a grate 80 or a grating system disposed over the opening 66. The grate 80 is capable of breaking down the material M into smaller pieces or section to facilitate movement of the material M through the opening 76. The grate 80 can be movably attached to the bucket 30 with a hinge 82. In the illustrated embodiment the hinge 82 is disposed on the upper edge 84 of the bucket 30 adjacent the opening 66. The grate 80 can be moved with a hydraulic actuator 86 that is controlled in the cab 32 of the construction vehicle 18. It is noted that the grate 80 can be connected in any manner desired and is not necessarily movable, can be movable in any manner desired or can be permanent or removably attached.

Figure 8:
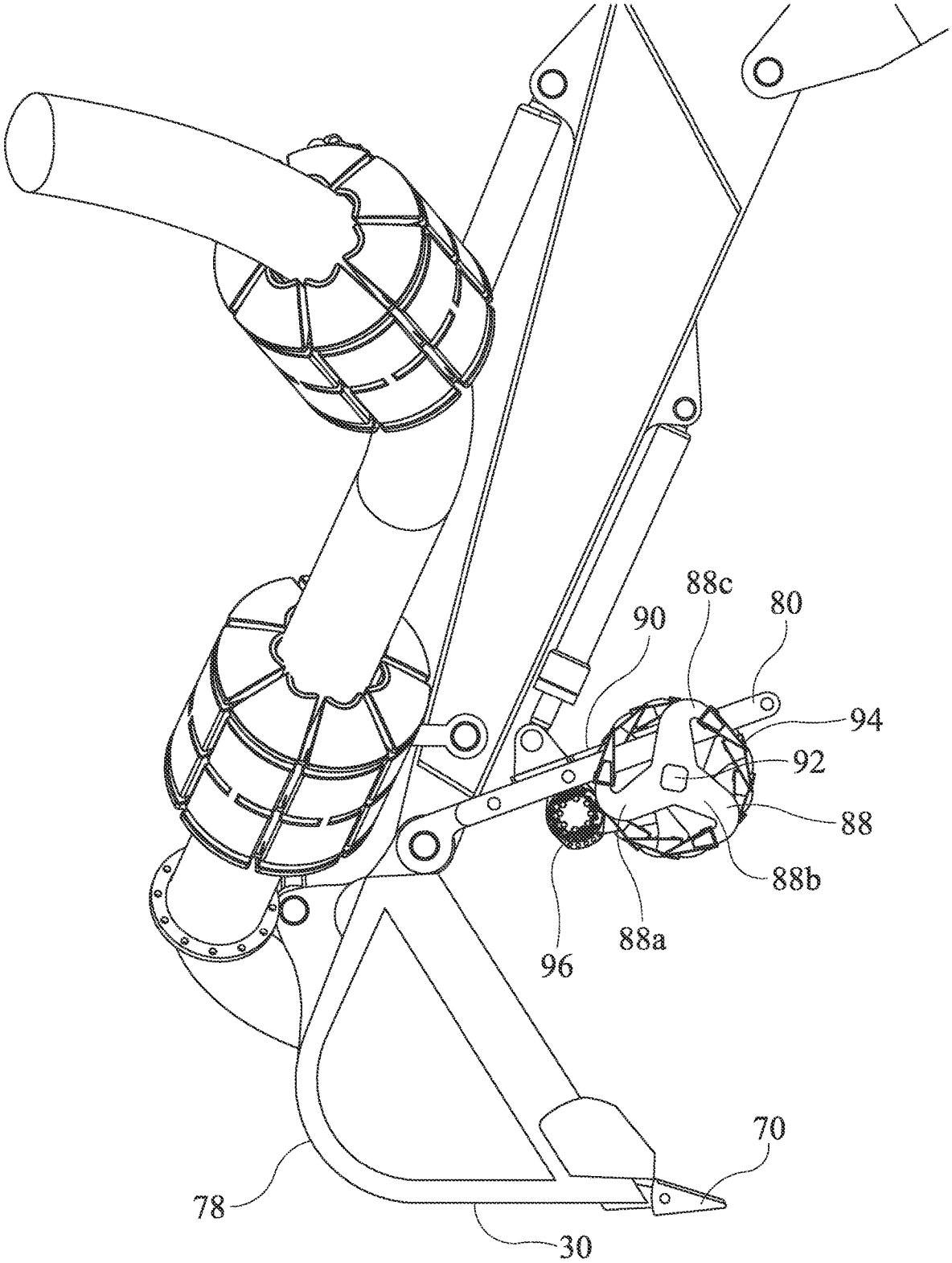
FIG. 8 is a side view of the bucket shown in FIG. 5 with the grate in an open position.

In another embodiment illustrated in the FIGS. 5-11, a plurality of agitators 88 are connected to the longitudinal bars 90 of the grate 80. In this embodiment, there are six (6) agitators 88 disposed between the longitudinal bars 90 of the grate 80 and connected on a drive axle 92. As shown in FIG. 8, the agitators 88 can include three arms 88*a*, 88*b*, and 88*c* with each arm including a two pronged claw 94 at the distal end. The arms 88*a*, 88*b*, and 88*c* can be curved to enable the claws 94 to strike the material M in a generally forward and downward manner. The agitators 88 are rotationally attached to the axle 92 and rotationally offset from each other. This configuration enables a continuous striking and agitating of the material M and improves breaking up of the material M.

The agitators 88 can be driven by a motor 96 that is connected to the axle 92. Thus, in this embodiment the plurality of agitators 88 are driven by a single motor that rotates the agitators 88 about the axle 92. However, it is understood that the agitators 77 can number in any number desired and can agitate in any manner desired. Moreover, the agitators 88 can be driven by a plurality of motors, if desired. For example, each agitator 88 can be driven by a separate motor.

As seen in FIGS. 5-11, the agitators 5-11 are coupled to the grate 80, such that when the grate is moved in an upward direction, the agitators 88 are also moved upwardly and away from the opening 66 of the bucket 30. Thus, as can be understood, the opening 66 can be fully exposed to enable access into and out of the interior area I of the bucket 30. Thus, access to the opening 76 in the back surface 78 of the bucket 30 can be easier, which can facilitate removal of any material that is suck or otherwise needs to be removed.

Figure 2:
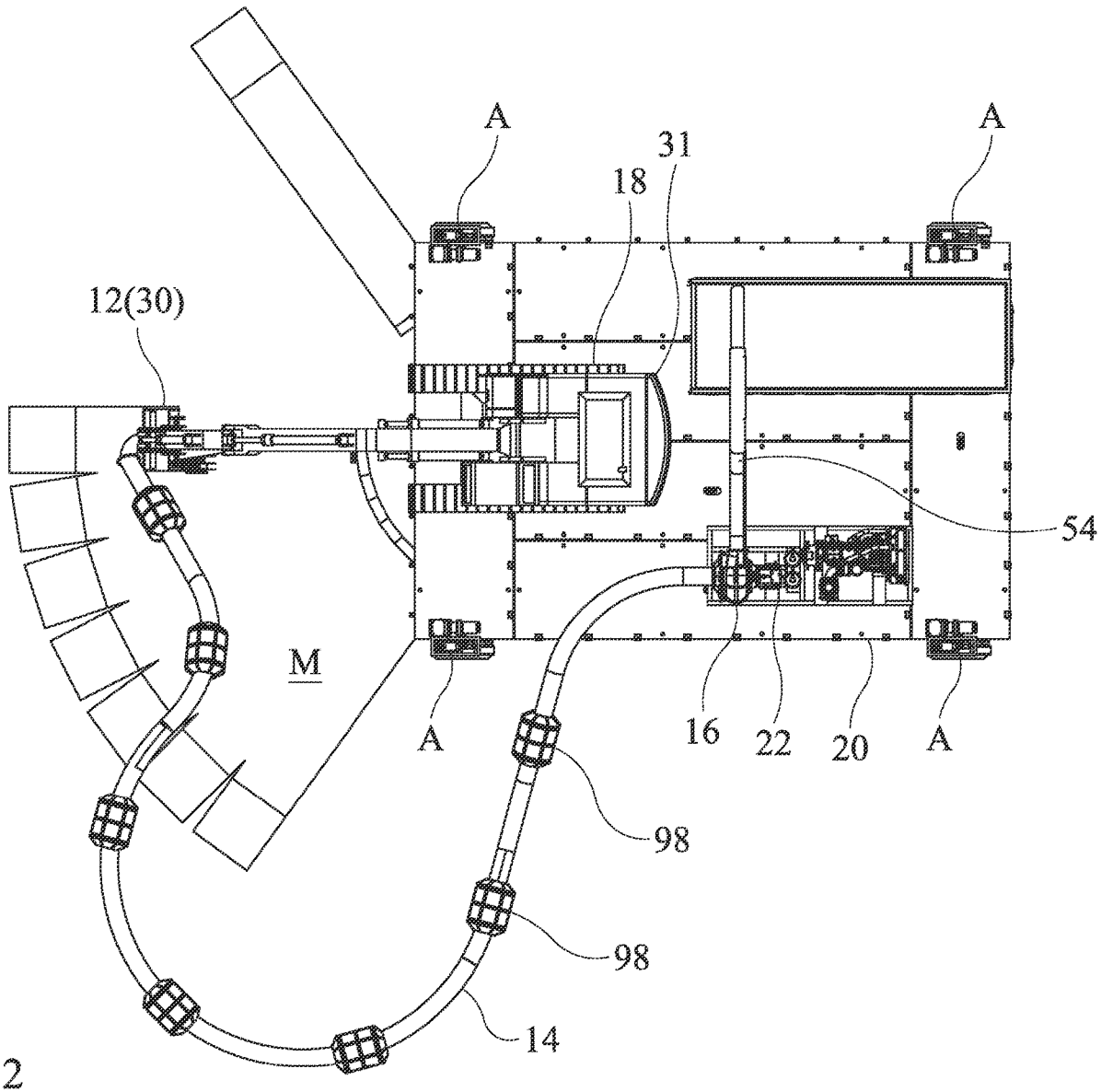
FIG. 2 is a top view of the dredge system of FIG. 1.
Figure 3:
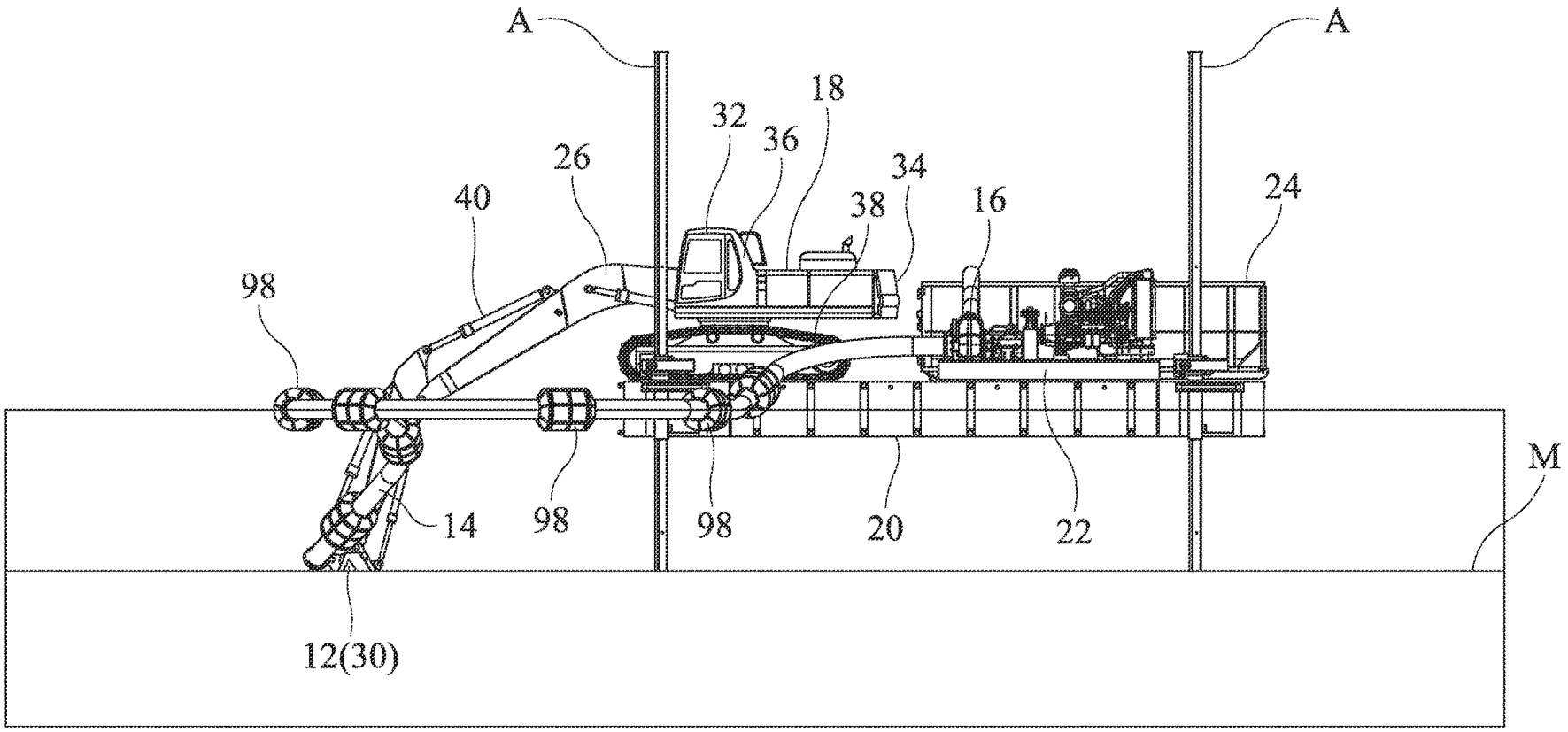
FIG. 3 is a side view of the dredge system of FIG. 1.
Figure 4:
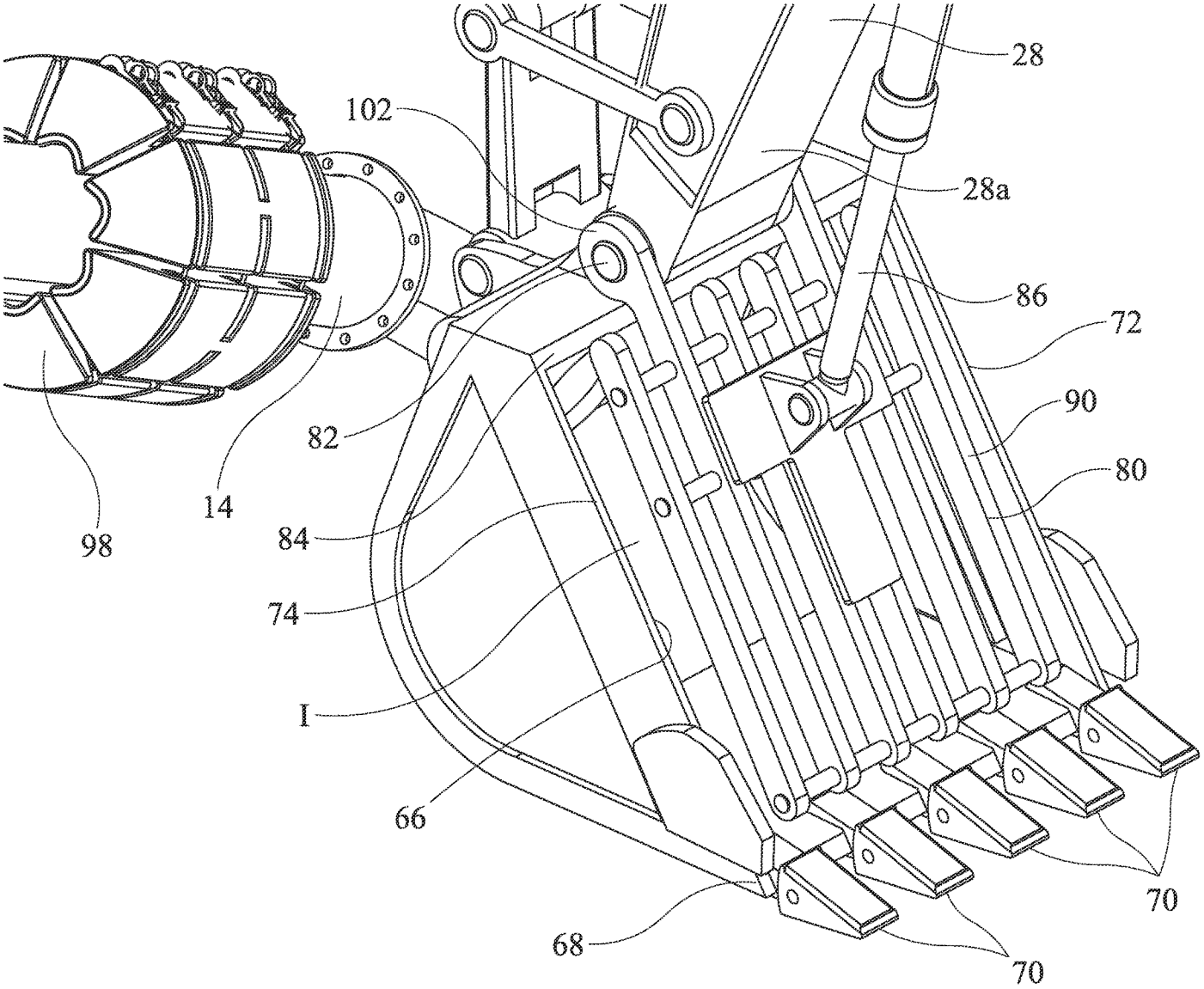
FIG. 4 is a front perspective view of the bucket for the dredge system shown in FIG. 1.
Figure 5:
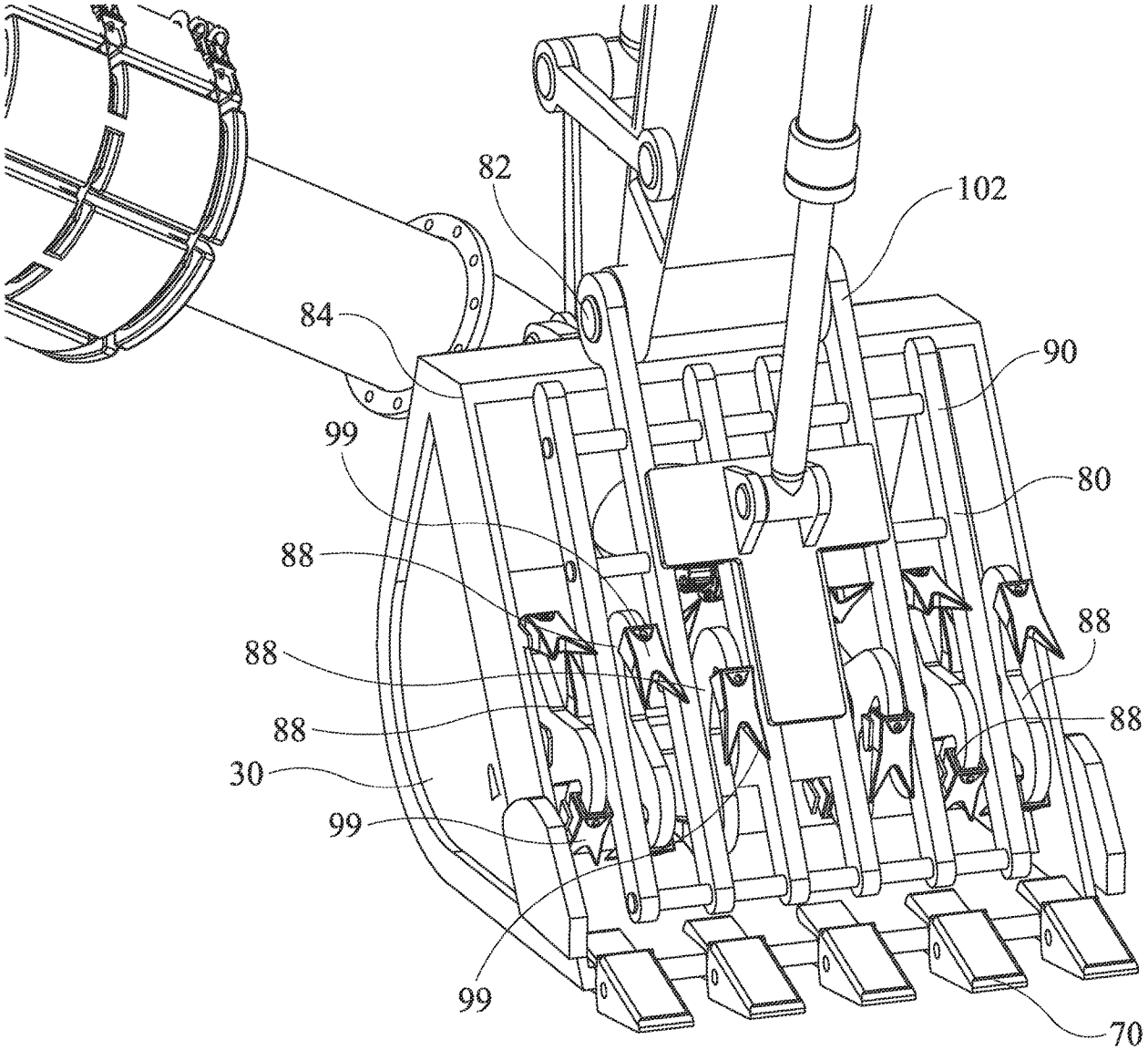
FIG. 5 is a s a front perspective view of the bucket with agitators.
Figure 6:
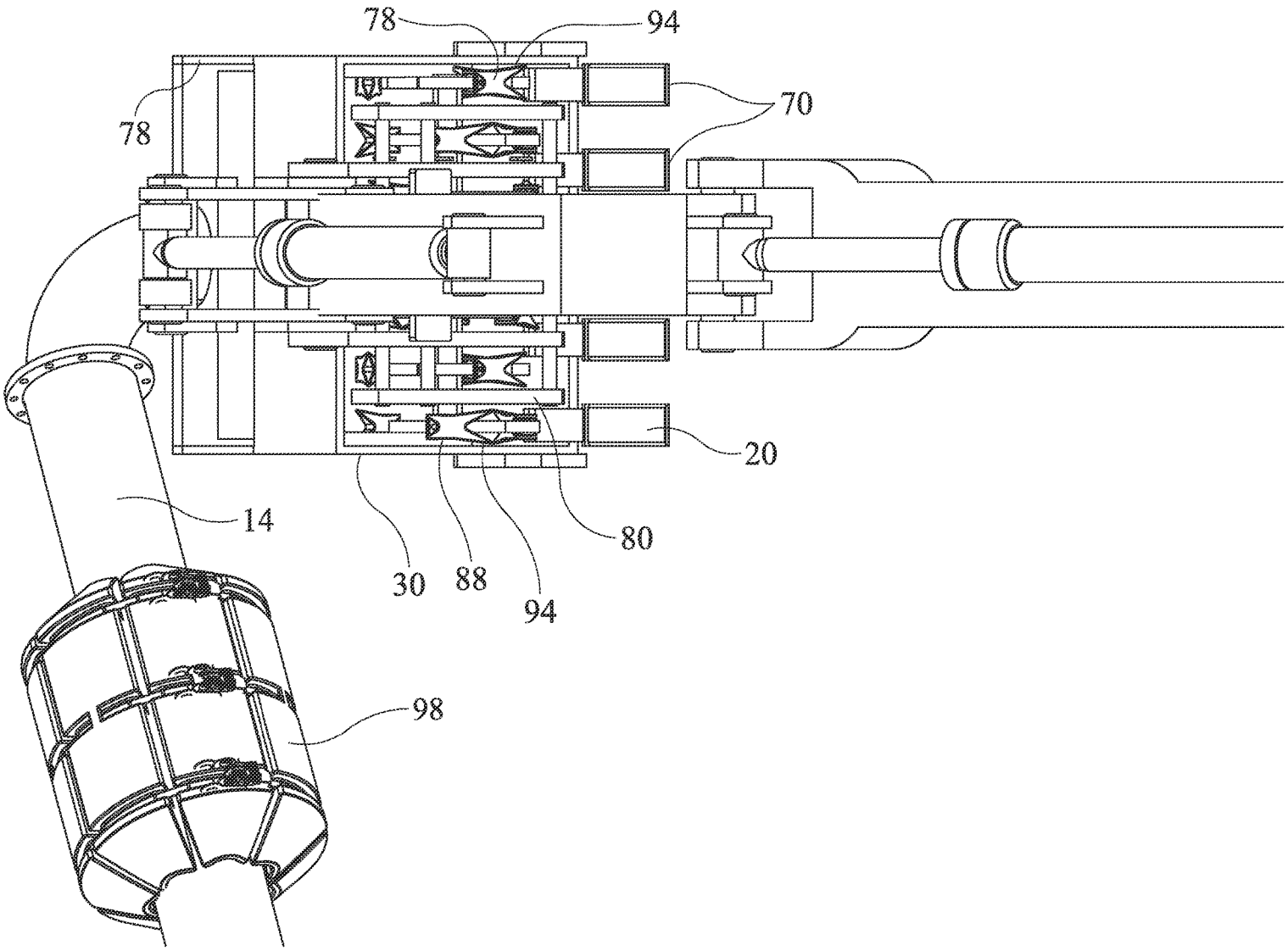
FIG. 6 is a top view of the bucket shown in FIG. 5.
Figure 7:
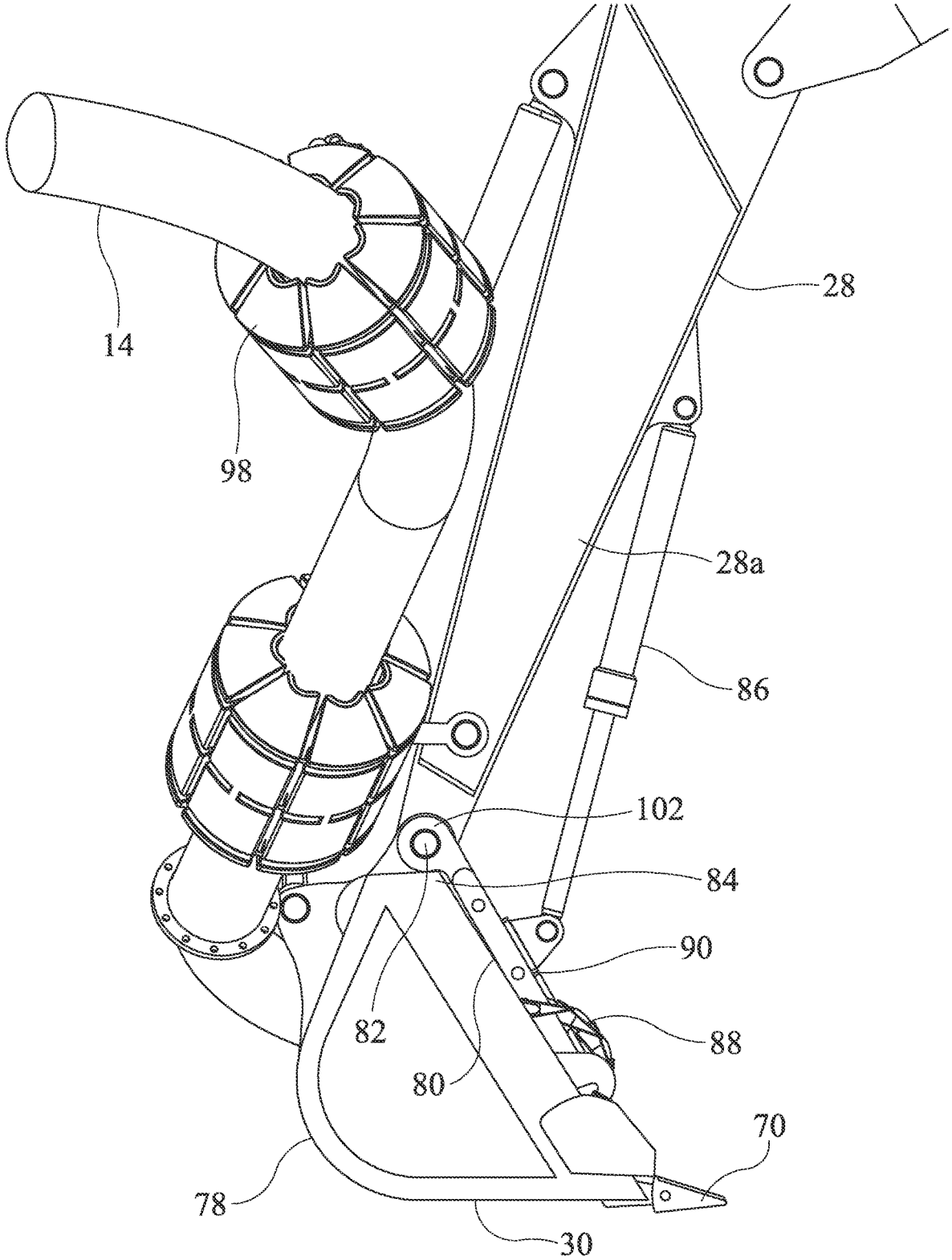
FIG. 7 is a side view of the bucket shown in FIG. 5.

As illustrated in FIGS. 1-3, the bucket 30 is capable of directing material M through the conduit 14, for example, an high-density polyethylene (HDPE) pipe. The conduit 14 can transport the material M to any suitable location such as, which can be a tank, and/or reservoir 24 for ultimate removal and disposal.

As the barge 20 moves through the material M bed, the conduit 14 is configured to travel along with the barge 20. In one embodiment, the conduit 14 includes floats 98 configured to be rotatable about an outer surface of the conduit 14 to enable the pipe to move with the barge 20. The floats 98 further enable the conduit 14 to remain on top of the surface if the material M is liquid or semiliquid or otherwise formed from a material M that would enable the pipe to sink therein.

In operation, the bucket 30 is attached to the dipper 28 using brackets disposed on the upper 84 of the bucket 30. In this embodiment the brackets 102 are attached to the hinge 82. The brackets 102 can be attached to hydraulic actuators that enable the bucket 30 to be pivoted in an upward and downward direction, such the bucket 30 can be facilitate a digger or scooping movement. The pump outlet 50 is attached to the conduit 54 and the pipe is connected to bucket 30 through conduit 14. Conduit 54 can be the same type of conduit as conduit 14 or it can be any other suitable conduit or pipe.

As can be understood, the barge can be a floating barge with sufficient buoyancy to carry the excavator 18, the pump 16 and the reservoir 24. Thus, the barge 20 can be moved to a desired location and the anchors A can be deployed to maintain the barge 20 in a specific location. The pump 16 and the agitators 88 can be started to enable the material M to be excavated.

The material M bed can be a dry material M or slurry, or any other suitable material M. As the bucket 30 moves through the material M bed material M is fed into the internal area I of bucket 30. The material M can be agitated or broken up using the agitators 88 and the longitudinal bars 90 of the grate 80, which shear and/or mix the material M and feed the material M to opening in the bucket 30 and into the conduit 14. The pump 16 causes suction within the conduit 14 and then pumps the material M through the pump inlet 48 through the housing 44 and out through the discharge outlet 50 and into the conduit 54, which in turn deposits the material M in a suitable location such as, stationary tank, and/or reservoir 24 for ultimate removal and disposal. As the bucket 30 moves through the material M bed the conduit 14 is configured to travel along with the bucket 30. In one embodiment, as noted above, the conduit 14 includes floats 98 configured to be rotatable about an outer surface of the conduit 14 to enable the conduit 14 to move with the bucket 30.

As the bucket 30 completes the dredging within a predetermined area, the anchors A of the barge 20 can be raised horizontally and the barge 20 can be moved to the next predetermined or suitable location. The above process can then be repeated until dredging is completed.

The construction vehicle is a conventional component that is well known in the art. Since construction vehicle is well known in the art, this structure will not be discussed or illustrated in detail herein. Rather, it will be apparent to those skilled in the art from this disclosure that the vehicle can include any type of structure and/or programming that can be used to carry out the present invention.

The embodiments of the present invention described herein improve the dredging process by providing a movable vehicle that loosens material M, extracts material M and transports the material M to be disposed in one process. Thus, the embodiments of the present invention described herein can decrease the time and expense in dredging.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), directional terms refer to those directions of a dredge system. Accordingly, these terms, as utilized to describe the present invention should be interpreted relative to a dredge system.

The term "configured" as used herein to describe a component, section or part of a device or element includes hardware and/or software that is constructed and/or programmed to carry out the desired function.

The terms of degree such as "generally", "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A dredge system comprising:

a dredger having an internal area and an outlet, and configured to feed material into the internal area of the dredger, the dredger including a bucket, a grate attached to the bucket via a hinge, and an agitator directly attached to the grate;

a conduit coupled to the dredger adjacent the outlet and configured to transport the material from the internal area of the dredger to a receptacle; and a self-priming pump coupled to the conduit and configured to pump the material from the outlet to the receptacle.

2. The dredge system of claim 1, wherein the bucket is of an excavator.

3. The dredge system of claim 1, wherein the outlet is disposed in a rear side of the bucket.

4. The dredge system of claim 1, wherein the self-priming pump is disposed remotely from the dredger.

5. The dredge system of claim 1, wherein the grate is disposed over an opening of the bucket.

6. The dredge system of claim 1, further comprising a power unit configured to operate the agitator.

7. The dredge system of claim 1, wherein the bucket includes an opening having an upper edge, and the hinge is disposed on the upper edge.

8. The dredge system of claim 1, wherein the grate includes a plurality of longitudinal bars, and the agitator includes a plurality of agitators attached to the plurality of longitudinal bars.

9. The dredge system of claim 8, wherein separate agitators are located between different longitudinal bars.

10. The dredge system of claim 1, wherein the agitator includes an axle that is rotationally attached to the grate.

11. A method of dredging, the method comprising:

operating a dredger having an internal area and an outlet, to feed material into the internal area of the dredger, the dredger including a bucket, a grate attached to the bucket via a hinge, and an agitator directly attached to the grate; and operating a self-priming pump to pump the material from the outlet to a receptacle via a conduit, the conduit coupled to the dredger adjacent the outlet at a first end and the self-priming pump at a second end.

12. The method of claim 11, wherein the bucket is of an excavator.

13. The method of claim 11, wherein the outlet is disposed in a rear side of the bucket.

14. The method of claim 11, wherein the self-priming pump is disposed remotely from the dredger.

15. The method of claim 11, further comprising shearing the material with the grate disposed over an opening of the dredger.

16. The method of claim 11, further comprising shearing the material with the agitator disposed at an opening of the dredger.

17. The method of claim 11, further comprising operating the agitator with a power unit.

18. The method of claim 11, comprising moving the grate and the agitator over an opening in the bucket prior to feeding the material into the internal area of the dredger.

19. The method of claim 11, wherein operating the dredger includes rotating the agitator with respect to the grate.

20. The method of claim 11, wherein operating the dredger includes rotating a plurality of offset agitators.

* * * * *